US008442833B2

(12) United States Patent
Chen

(10) Patent No.: US 8,442,833 B2
(45) Date of Patent: May 14, 2013

(54) SPEECH PROCESSING WITH SOURCE LOCATION ESTIMATION USING SIGNALS FROM TWO OR MORE MICROPHONES

(75) Inventor: Ruxin Chen, Redwood City, CA (US)

(73) Assignee: Sony Computer Entertainment Inc., Tokyo (JP)

( * ) Notice: Subject to any disclaimer, the term of this patent is extended or adjusted under 35 U.S.C. 154(b) by 573 days.

(21) Appl. No.: 12/698,920

(22) Filed: Feb. 2, 2010

(65) Prior Publication Data

US 2010/0211387 A1 Aug. 19, 2010

Related U.S. Application Data

(60) Provisional application No. 61/153,260, filed on Feb. 17, 2009.

(51) Int. Cl.
*G10L 21/00* (2006.01)

(52) U.S. Cl.
USPC ..... 704/270; 704/270.1; 704/256; 704/257; 704/251

(58) Field of Classification Search ..... 704/270, 704/270.1, 236, 256, 251, 230, 240, 231, 704/254, 243, 225, 257, 8, 9, 255, 256.4, 704/265, 250, 203; 382/181, 218, 100; 348/14.09, 348/14.08, 515
See application file for complete search history.

(56) References Cited

U.S. PATENT DOCUMENTS

| | | | | |
|---|---|---|---|---|
| 4,956,865 | A | 9/1990 | Lennig et al. | 704/241 |
| 4,977,598 | A | 12/1990 | Doddington et al. | 704/255 |
| RE33,597 | E | 5/1991 | Levinson et al. | 704/256 |
| 5,031,217 | A | 7/1991 | Nishimura | 704/256.4 |
| 5,050,215 | A | 9/1991 | Nishimura | 704/256.4 |
| 5,129,002 | A | 7/1992 | Tsuboka | 704/246 |
| 5,148,489 | A | 9/1992 | Erell et al. | 704/226 |
| 5,222,190 | A | 6/1993 | Pawate et al. | 704/200 |
| 5,228,087 | A | 7/1993 | Bickerton | 704/232 |
| 5,345,536 | A | 9/1994 | Hoshimi et al. | 704/243 |
| 5,353,377 | A | 10/1994 | Kuroda et al. | 704/256.1 |
| 5,438,630 | A | 8/1995 | Chen et al. | 382/159 |
| 5,455,888 | A | 10/1995 | Iyengar et al. | 704/203 |
| 5,459,798 | A | 10/1995 | Bailey et al. | 382/218 |
| 5,473,728 | A | 12/1995 | Luginbuhl et al. | 704/243 |
| 5,502,790 | A | 3/1996 | Yi | 704/256 |

(Continued)

FOREIGN PATENT DOCUMENTS

| | | |
|---|---|---|
| EP | 0866442 | 9/1998 |
| WO | WO 2004111999 A1 | 12/2004 |

OTHER PUBLICATIONS

Lawrence Rabiner, "A Tutorial on Hidden Markov Models and Selected Application Speech Recognition"—Proceeding of the IEEE, vol. 77, No. 2, Feb. 1989.

(Continued)

*Primary Examiner* — Vijay B Chawan
(74) *Attorney, Agent, or Firm* — Joshua D. Isenberg; JDI Patent

(57) ABSTRACT

Computer implemented speech processing is disclosed. First and second voice segments are extracted from first and second microphone signals originating from first and second microphones. The first and second voice segments correspond to a voice sound originating from a common source. An estimated source location is generated based on a relative energy of the first and second voice segments and/or a correlation of the first and second voice segments. A determination whether the voice segment is desired or undesired may be made based on the estimated source location.

22 Claims, 7 Drawing Sheets

U.S. PATENT DOCUMENTS

| | | | | |
|---|---|---|---|---|
| 5,506,933 | A | 4/1996 | Nitta | 704/256 |
| 5,509,104 | A | 4/1996 | Lee et al. | 704/256 |
| 5,535,305 | A | 7/1996 | Acero et al. | 704/256 |
| 5,581,655 | A | 12/1996 | Cohen et al. | 704/245 |
| 5,602,960 | A | 2/1997 | Hon et al. | 704/207 |
| 5,608,840 | A | 3/1997 | Tsuboka | 704/236 |
| 5,615,296 | A | 3/1997 | Stanford et al. | 704/270.1 |
| 5,617,407 | A | 4/1997 | Bareis | 369/275.3 |
| 5,617,486 | A | 4/1997 | Chow et al. | 382/181 |
| 5,617,509 | A | 4/1997 | Kushner et al. | 704/256 |
| 5,627,939 | A | 5/1997 | Huang et al. | 704/256 |
| 5,649,056 | A | 7/1997 | Nitta | 704/256 |
| 5,649,057 | A | 7/1997 | Lee et al. | 704/256 |
| 5,655,057 | A | 8/1997 | Takagi | 704/233 |
| 5,677,988 | A | 10/1997 | Takami et al. | 704/256 |
| 5,680,506 | A | 10/1997 | Kroon et al. | 704/203 |
| 5,680,510 | A | 10/1997 | Hon et al. | 704/255 |
| 5,719,996 | A | 2/1998 | Chang et al. | 704/256 |
| 5,745,600 | A | 4/1998 | Chen et al. | 382/218 |
| 5,758,023 | A | 5/1998 | Bordeaux | 704/232 |
| 5,787,396 | A | 7/1998 | Komori et al. | 704/256 |
| 5,794,190 | A | 8/1998 | Linggard et al. | 704/232 |
| 5,799,278 | A | 8/1998 | Cobbett et al. | 704/256 |
| 5,812,974 | A | 9/1998 | Hemphill et al. | 704/256.4 |
| 5,825,978 | A | 10/1998 | Digalakis et al. | 704/256 |
| 5,835,890 | A | 11/1998 | Matsui et al. | 704/255 |
| 5,860,062 | A | 1/1999 | Taniguchi et al. | 704/256 |
| 5,880,788 | A | 3/1999 | Bregler | 348/515 |
| 5,890,114 | A | 3/1999 | Yi | 704/256 |
| 5,893,059 | A | 4/1999 | Raman | 704/256.2 |
| 5,903,865 | A | 5/1999 | Ishimitsu et al. | 704/256 |
| 5,907,825 | A | 5/1999 | Tzirkel-Hancock | 704/243 |
| 5,913,193 | A | 6/1999 | Huang et al. | 704/258 |
| 5,930,753 | A | 7/1999 | Potamianos et al. | 704/256.2 |
| 5,937,384 | A | 8/1999 | Huang et al. | 704/256 |
| 5,943,647 | A | 8/1999 | Ranta | 704/251 |
| 5,956,683 | A | 9/1999 | Jacobs et al. | 704/270.1 |
| 5,963,903 | A | 10/1999 | Hon et al. | 704/254 |
| 5,963,906 | A | 10/1999 | Turin | 704/256 |
| 5,983,178 | A | 11/1999 | Naito et al. | 704/245 |
| 5,983,180 | A | 11/1999 | Robinson | 704/254 |
| 6,009,390 | A | 12/1999 | Gupta et al. | 704/240 |
| 6,009,391 | A | 12/1999 | Asghar et al. | 704/243 |
| 6,023,677 | A | 2/2000 | Class et al. | 704/254 |
| 6,035,271 | A | 3/2000 | Chen | 704/207 |
| 6,061,652 | A | 5/2000 | Tsuboka et al. | 704/245 |
| 6,067,520 | A | 5/2000 | Lee | 704/270 |
| 6,078,884 | A | 6/2000 | Downey | 704/243 |
| 6,092,042 | A | 7/2000 | Iso | 704/240 |
| 6,112,175 | A | 8/2000 | Chengalvarayan | 704/256.5 |
| 6,138,095 | A | 10/2000 | Gupta et al. | 704/234 |
| 6,138,097 | A | 10/2000 | Lockwood et al. | 704/256.2 |
| 6,148,284 | A | 11/2000 | Saul | 704/256.4 |
| 6,151,573 | A | 11/2000 | Gong | 704/256.2 |
| 6,151,574 | A | 11/2000 | Lee et al. | 704/256 |
| 6,188,982 | B1 | 2/2001 | Chiang | 704/256.5 |
| 6,223,159 | B1 | 4/2001 | Ishii | 704/256.7 |
| 6,226,612 | B1 | 5/2001 | Srenger et al. | 704/256.2 |
| 6,236,963 | B1 | 5/2001 | Naito et al. | 704/241 |
| 6,246,980 | B1 | 6/2001 | Glorion et al. | 704/231 |
| 6,253,180 | B1 | 6/2001 | Iso | 704/244 |
| 6,256,607 | B1 | 7/2001 | Digalakis et al. | 704/222 |
| 6,292,776 | B1 | 9/2001 | Chengalvarayan | 704/219 |
| 6,405,168 | B1 | 6/2002 | Bayya et al. | 704/256 |
| 6,415,256 | B1 | 7/2002 | Ditzik | 704/231 |
| 6,442,519 | B1 | 8/2002 | Kanevsky et al. | 704/243 |
| 6,446,039 | B1 | 9/2002 | Miyazawa et al. | 704/255 |
| 6,456,965 | B1 | 9/2002 | Yeldener | 704/207 |
| 6,526,380 | B1 | 2/2003 | Thelen et al. | 704/251 |
| 6,593,956 | B1 | 7/2003 | Potts et al. | 348/14.09 |
| 6,629,073 | B1 | 9/2003 | Hon et al. | 704/256.4 |
| 6,662,160 | B1 | 12/2003 | Wu et al. | 704/256 |
| 6,671,666 | B1 | 12/2003 | Ponting et al. | 704/233 |
| 6,671,668 | B2 | 12/2003 | Harris | 704/246 |
| 6,671,669 | B1 | 12/2003 | Garudadri et al. | 704/255 |
| 6,681,207 | B2 | 1/2004 | Garudadri | 704/256 |
| 6,721,699 | B2 | 4/2004 | Xu et al. | 704/207 |
| 6,757,652 | B1 | 6/2004 | Lund et al. | 704/254 |
| 6,801,892 | B2 | 10/2004 | Yamamoto | 704/256 |
| 6,832,190 | B1 | 12/2004 | Junkawitsch et al. | 704/255 |
| 6,868,382 | B2 | 3/2005 | Shozakai | 704/254 |
| 6,901,365 | B2 | 5/2005 | Miyazawa | 704/256 |
| 6,907,398 | B2 | 6/2005 | Hoege | 704/265 |
| 6,934,681 | B1 | 8/2005 | Emori et al. | 704/250 |
| 6,963,836 | B2 | 11/2005 | Van Gestel | 704/251 |
| 6,980,952 | B1 | 12/2005 | Gong | 704/234 |
| 7,003,460 | B1 | 2/2006 | Bub et al. | 704/256 |
| 7,133,535 | B2 | 11/2006 | Huang et al. | 382/100 |
| 7,139,707 | B2 | 11/2006 | Sheikhzadeh-Nadjar et al. | 704/243 |
| 7,269,556 | B2 | 9/2007 | Kiss et al. | 704/245 |
| 2002/0116196 | A1 | 8/2002 | Tran | 704/270 |
| 2003/0033145 | A1 | 2/2003 | Petrushin | 704/236 |
| 2003/0177006 | A1 | 9/2003 | Ichikawa et al. | 704/231 |
| 2004/0059576 | A1 | 3/2004 | Lucke | 704/256.7 |
| 2004/0078195 | A1 | 4/2004 | Oda et al. | 704/207 |
| 2004/0088163 | A1 | 5/2004 | Schalkwyk | 704/251 |
| 2004/0220804 | A1 | 11/2004 | Odell | 704/230 |
| 2005/0010408 | A1 | 1/2005 | Nakagawa et al. | 704/240 |
| 2005/0038655 | A1 | 2/2005 | Mutel et al. | 704/256 |
| 2005/0065789 | A1 | 3/2005 | Yacoub et al. | 704/231 |
| 2005/0286705 | A1 | 12/2005 | Contolini et al. | 379/265.02 |
| 2006/0020462 | A1 | 1/2006 | Reich | 704/254 |
| 2006/0031069 | A1 | 2/2006 | Huang et al. | 704/243 |
| 2006/0031070 | A1 | 2/2006 | Abrego et al. | 704/243 |
| 2006/0178876 | A1 | 8/2006 | Sato et al. | 704/225 |
| 2006/0224384 | A1 | 10/2006 | Dow et al. | 704/257 |
| 2006/0229864 | A1 | 10/2006 | Suontausta et al. | 704/8 |
| 2006/0277032 | A1 | 12/2006 | Hernandez-Abrego et al. | 704/9 |
| 2007/0112566 | A1 | 5/2007 | Chen | 704/240 |
| 2007/0198261 | A1 | 8/2007 | Chen | 704/240 |
| 2007/0198263 | A1 | 8/2007 | Chen | 704/246 |
| 2008/0052062 | A1 | 2/2008 | Stanford | 704/8 |
| 2009/0024720 | A1 | 1/2009 | Karray et al. | 709/219 |

OTHER PUBLICATIONS

Steven B. Davis et al., "Comparison of Parametric Representations for Monosyllabic Word Recognition in Continuously Spoken Sentences"—IEEE Transactions on Acoustics, Speech, and Signal Processing, vol. ASSP 28, No. 4, p. 357-366, Aug. 1980.

G. David Forney, Jr., "The Viterbi Agorithm"—Proceeding of the IEEE, vol. 61, No. 3, p. 268-278, Mar. 1973.

Kai-Fu Lee et al., "Speaker-Independent phone Recognition Using Hidden Markov Models"—IEEE Transaction in Acoustics, Speech, and Signal Processing, vol. 37, No. 11, p. 1641-1648, Nov. 1989.

Hans Werner Strube, "Linear Prediction on a Warped Frequency Scale,"—The Journal of the Acoustical Society of America, vol. 68, No. 4, p. 1071-1076, Oct. 1980.

Leonard E. Baum et al., "A Maximization Technique Occurring in the Statistical Analysis of Probabilistic Functions of Markov Chains,"—The Annals of Mathematical Statistics, vol. 41, No. 1, p. 164-171, Feb. 1970.

Rohit Sinha et al., "Non-Uniform Scaling Based Speaker Normalization" 2002 IEEE, May 13, 2002, vol. 4, pp. I-589-I-592.

Li Lee et al., "Speaker Normalization Using Efficient Frequency Warping Procedures" 1996 IEEE, vol. 1, pp. 353-356.

Vasilache, "Speech recognition Using HMMs With Quantized Parameters", Oct. 2000, 6th International Conference on Spoken Language Processing (ICSLP 2000), pp. 1-4.

Bocchieri, "Vector Quantization for the Efficient Computation of Continuous Density Likelihoods", Apr. 1993, International conference on Acoustics, Speech, and Signal Processing, IEEE, pp. 692-695.

Claes et al. "A Novel Feature Transformation for Vocal Tract Length Normalization in Automatic Speech Recognition", IEEE Transformations on Speech and Audio Processing, vol. 6, 1998, pp. 549-557.

M. Tamura et al. "Adaptation of Pitch and Spectrum for HMM-Based Speech Synthesis Using MLLR", proc of ICASSP 2001, v1. 1, pp. 1-1, May 2001.

Cherif A, "Pitch and Formants Extraction Algorithm for Speech Processing," Electronics, Circuits and Systems, 2000, ICECS 2000. The 7th IEEE International Conference on vol. 1, Dec. 17-20, 2000, pp. 595-598, vol. 1.

L. Lee, R. C. Rose, "A frequency warping approach to speaker normalization," in IEEE Transactions on Speech and Audio Processing, vol. 6, No. 1, pp. 49-60, Jan. 1998.

W. H. Abdulla and N. K. Kasabov. 2001. Improving speech recognition performance through gender separation. In Proceedings of ANNES, pp. 218-222.

Iseli, M., Y. Shue, and a. Alwan (2006). Age- and Gender-Dependent Analysis of Voice Source Characteristics, Proc. ICASSP, Toulouse.

U.S. Appl. No. 61/153,260 entitled "Speech Processing With Source Location Estimation Using Signals From Two or More Microphones", filed Feb. 17, 2009.

U.S. Appl. No. 12/099,046 entitled "Gaming Headset and Charging Method", filed Apr. 7, 2008.

"Cell Broadband Engine Architecture", copyright International Business Machines Corporation, Sony Computer Entertainment Incorporated, Toshiba Corporation Aug. 8, 2005, which may be downloaded at http://cell.scei.co.jp/.

International Search Report and Written Opinion dated Mar. 19, 2010 issued for International Application PCT/US10/23098.

International Search Report and Written Opinion dated Mar. 22, 2010 issued for International Application PCT/US10/23102.

International Search Report and Written Opinion dated Apr. 5, 2010 issued for International Application PCT/US10/23105.

```
int mc1 = max_c>=c1 && (max_cor>r1 || c1c2>cc0 && max_cor>r2);
int mc2 = max_c>=0 && max_c<c1 && (1.0f*max_c - max_cor < r3) &&
  (max_cor>rr3 || max_c>=1 && c1c2>cc1 || max_c==0 && c1c2>cc2);
     if (mc1 || mc2) {
       rcr->location.distance = 5;
     } else {
       rcr->location.distance = 20;
     }
```

FIG. 2B

© 2009 SONY COMPUTER ENTERTAINMENT INC.

```
if (max_c> mic_c) max_c =  mic_c;
if (max_c<-mic_c) max_c  = -mic_c;
direction =
acosf((float)max_c/mic_c)*90/1.5708;
```

FIG. 2C

© 2009 SONY COMPUTER ENTERTAINMENT INC.

SPEECH PROCESSING WITH SOURCE LOCATION ESTIMATION USING SIGNALS FROM TWO OR MORE MICROPHONES

CROSS-REFERENCE TO RELATED APPLICATION

This application claims the benefit of priority of U.S. provisional application No. 61/153,260, entitled MULTIPLE LANGUAGE VOICE RECOGNITION, filed Feb. 17, 2009, the entire disclosures of which are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but other-wise reserves all copyright rights whatsoever.

FIELD OF INVENTION

Embodiments of the present invention relate generally to computer-implemented voice recognition, and more particularly, to a method and apparatus that estimates a distance and direction to a speaker based on input from two or more microphones.

BACKGROUND OF INVENTION

A speech recognition system receives an audio stream and filters the audio stream to extract and isolate sound segments that make up speech. Speech recognition technologies allow computers and other electronic devices equipped with a source of sound input, such as a microphone, to interpret human speech, e.g., for transcription or as an alternative method of interacting with a computer. Speech recognition software is being developed for use in consumer electronic devices such as mobile telephones, game platforms, personal computers and personal digital assistants. In a typical speech recognition algorithm, a time domain signal representing human speech is broken into a number of time windows and each window is converted to a frequency domain signal, e.g., by fast Fourier transform (FFT). This frequency or spectral domain signal is then compressed by taking a logarithm of the spectral domain signal and then performing another FFT. From the compressed signal, a statistical model can be used to determine phonemes and context within the speech represented by the signal. The extracted phonemes and context may be compared to stored entries in a database to determine the word or words that have been spoken.

In the field of computer speech recognition a speech recognition system receives an audio stream and filters the audio stream to extract and isolate sound segments that make up speech. The sound segments are sometimes referred to as phonemes. The speech recognition engine then analyzes the phonemes by comparing them to a defined pronunciation dictionary, grammar recognition network and an acoustic model.

Speech recognition systems are usually equipped with a way to compose words and sentences from more fundamental units. For example, in a speech recognition system based on phoneme models, pronunciation dictionaries can be used as look-up tables to build words from their phonetic transcriptions. A grammar recognition network can then interconnect the words.

A data structure that relates words in a given language represented, e.g., in some graphical form (e.g., letters or symbols) to particular combinations of phonemes is generally referred to as a Grammar and Dictionary (GnD). An example of a Grammar and Dictionary is described, e.g., in U.S. Patent Application publication number 20060277032 to Gustavo Hernandez-Abrego and Ruxin Chen entitled Structure for Grammar and Dictionary Representation in Voice Recognition and Method For Simplifying Link and Node-Generated Grammars, the entire contents of which are incorporated herein by reference.

Certain applications utilize computer speech recognition to implement voice activated commands. One example of a category of such applications is computer video games. Speech recognition is sometimes used in video games, e.g., to allow a user to select or issue a command or to select an option from a menu by speaking predetermined words or phrases.

Video game devices and other applications that use speech recognition are often used in noisy environments that may include sources of speech other than the person playing the game or using the application. In such situations, stray speech from persons other than the user may inadvertently trigger a command or menu selection.

Some prior art applications that use speech recognition, e.g., for voice activated commands, also use two microphones. Prior art solutions have either performed voice detection on only one microphone signal. Unfortunately voice volume is very unreliable for source distance estimation because the real voice volume of the source is unknown. Furthermore, determining whether a voice signal in a noisy game environment corresponds to an intended voice or an unwanted voice is particularly challenging for a single source.

Other prior art systems perform signal arrival direction estimation using an array of sound signals from an array of microphones. Unfortunately, prior art systems based on arrays of microphones generally utilize far-field microphones that are not used for close talk. Consequently, signals from such microphones are sub-optimal for speech recognition.

It is within this context that embodiments of the current invention arise.

BRIEF DESCRIPTION OF THE DRAWINGS

FIG. 2B is a listing of code for implementing source location in speech processing according to an embodiment of the present invention.

FIG. 2C is a listing of code for implementing source direction in speech processing according to an embodiment of the present invention.

Figure 1A:
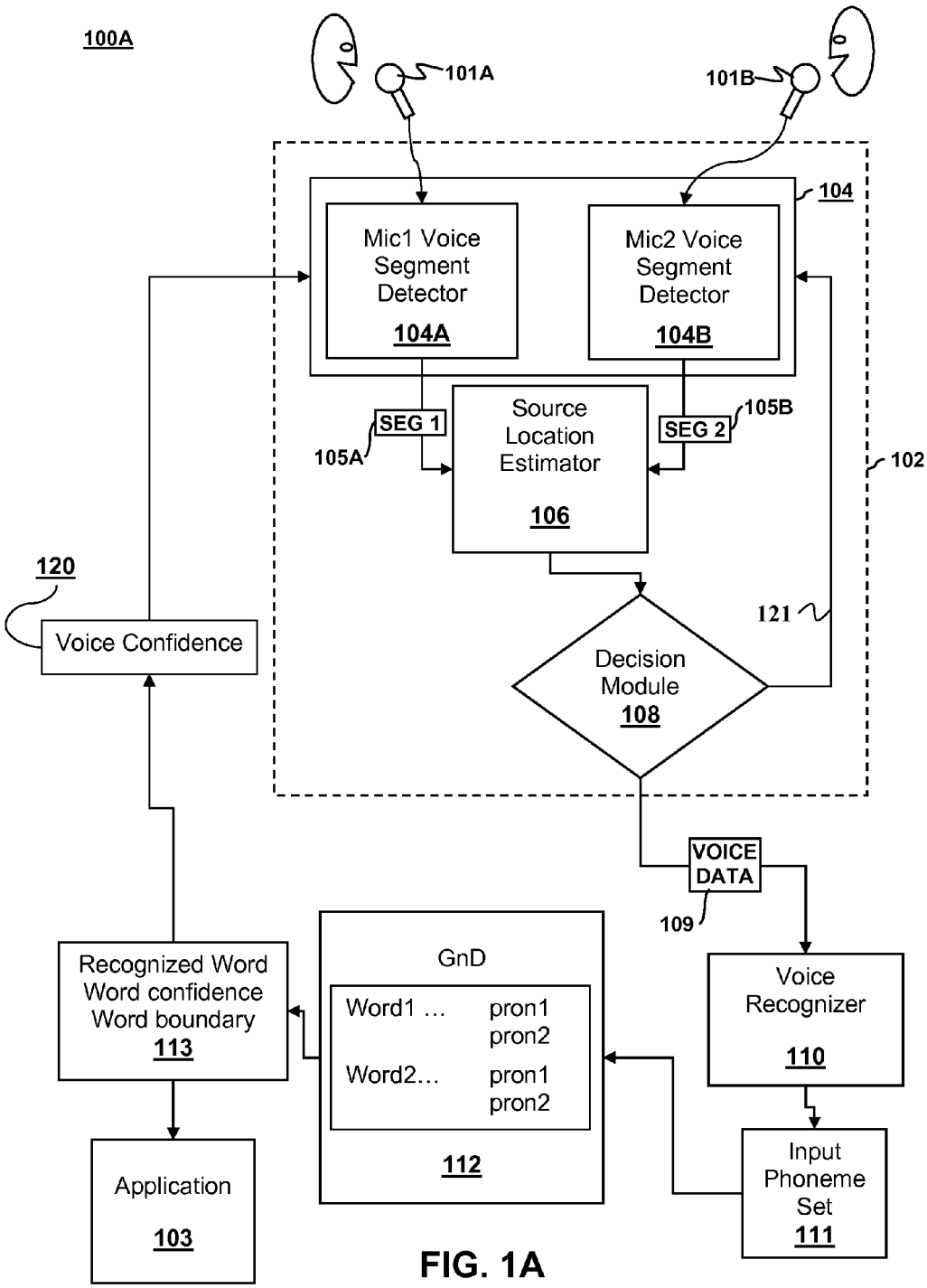
FIGS. 1A-1C are block diagrams illustrating different versions of a speech processing system according to an embodiment of the present invention.

Common reference numerals are used to refer to common features of the drawings.

DESCRIPTION OF THE SPECIFIC EMBODIMENTS

According to an embodiment of the invention, a distance and direction of a source of sound are estimated based on input from two or more microphone signals from two or more different microphones. The distance and direction estimation are used to determine whether the speech segment is coming from a predetermined source. The distance and direction may be determined by comparing the volume and time of arrival delay property of signals from different microphones corresponding to a short segment of a single human voice signal. The distance and direction information can be used to reject background human speech.

By combining detection of a voice signal on two or more channels with information regarding the volume of the speech signals and their time delay properties, embodiments of the invention may reliably estimate the intended voice signal for a pre-specified microphone. This is especially true for microphones with closed talk sensitivity.

As seen in FIG. 1A, a speech recognition system 100A may generally include a sound source discriminator 102. The system 100A may use the sound source discriminator 102 in conjunction with an application 103, a voice recognizer 110 and a grammar and dictionary 112. The sound source discriminator 102, application 103, voice recognizer 110, and grammar and dictionary 112 may be implemented in hardware, software or firmware or any suitable combination of two or more of hardware, software, or firmware. By way of example, and not by way of limitation, the sound source discriminator 102, application 103, voice recognizer 110, and grammar and dictionary 112 may be implemented in software as a set of computer executable instructions and associated configured to implement the functions described herein on a general purpose computer. The system 100A may also operate in conjunction with signals from two or more microphones 101A, 101B.

Figure 2A:
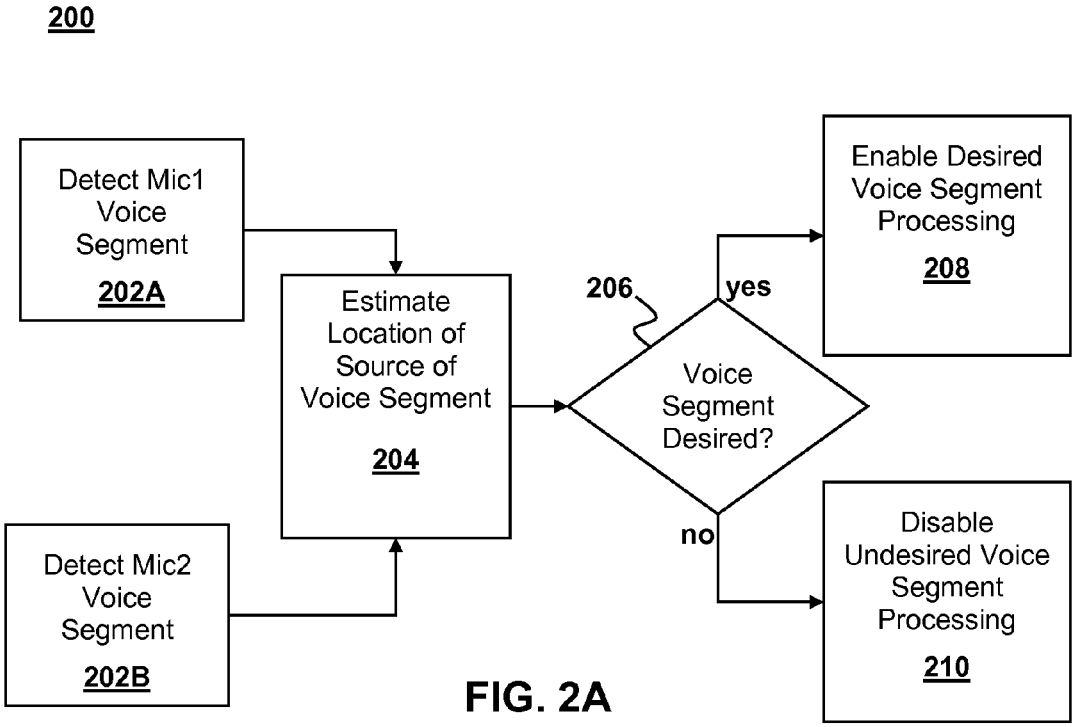
FIG. 2A is a diagram illustrating a speech processing method in accordance with an embodiment of the present invention.

By way of example, and not by way of limitation, the system 100A may operate according to a method 200 as illustrated in FIG. 2A. Specifically, voice segments from a common source may be detected at both microphones as indicated at 202A, 202B. The voice segments may be analyzed to estimate a location of the source, as indicated at 204. Based on the estimated location, a decision may be made as to whether the sound segment originated from a desired source, as indicated at 206. If the source is a desired, further processing (e.g., voice recognition) may be performed on the voice segment, as indicated at 208. Otherwise, further processing of the voice segment may be disabled, as indicated at 210.

In the example depicted in FIG. 1A, each microphone 101A, 101B may be operated by a different user during part of the application. An example of such an application is a singing competition video game known as SingStar®. SingStar® is a registered trademark of Sony Computer Entertainment Europe.

In the embodiment depicted in FIG. 1A, the signal from only one microphone (e.g., a "blue" microphone 101A) is used for voice control command functions, such as menu selection, song selection, and the like and the other microphone (e.g., a "red" microphone "101B". However, both microphones 101A, 101B are used for other portions of the application, such as a singing competition. The microphones may be coupled to the rest of the system 100A through a wired or wireless connection. Signals from the red microphone 101B are normally ignored by the application 103 or voice recognizer 110 for voice control command functions. It is noted that for the embodiment depicted in FIG. 1A, it does not matter whether both microphones are synchronized to a common clock.

The sound source discriminator 102 may generally include the following subcomponents: an input module 104 having one or more voice segment detector modules 104A, 104B, a source location estimator module 106, and a decision module 108. All of these subcomponents may be implemented in hardware, software, or firmware or combinations of two or more of these.

The voice segment detector modules 104A, 104B are configured, e.g., by suitable software programming, to isolate a common voice segment from first and second microphone signals originating respectively from the red and blue microphones 101A, 101B. The voice segment detector modules 104A, 104B may receive electrical signals from the microphones 101A, 101B that correspond to sounds respectively detected by the microphones 101A, 101B. The microphone signals may be in either analog or digital format. If in analog format, the voice segment detector modules 104A, 104B may include analog to digital A/D converters to convert the incoming microphone signals to digital format. Alternatively, the microphones 101A, 101B may include A/D converters so that the voice segment detector modules receive the microphone signals in digital format.

By way of example, each microphone 101A, 101B may convert speech sounds from a common speaker into an electrical signal using an electrical transducer. The electrical signal may be an analog signal, which may be converted to a digital signal through use of an A/D converter. The digital signal may then be divided into a multiple units called frames, each of which may be further subdivided into samples. The value of each sample may represent sound amplitude at a particular instant in time.

The voice segment detector modules 104A, 104B sample the two microphone signals to determine when a voice segment begins and ends. Each voice segment detector module may analyze the frequency and amplitude of its corresponding incoming microphone signal as a function of time to determine if the microphone signal corresponds to sounds in the range of human speech. In some embodiments, the two voice segment detector modules 104A, 104B may perform up-sampling on the incoming microphone signals and analyze the resulting up-sampled signals. For example, if the incoming signals are sampled at 16 kilohertz, the voice segment detector modules may up-sample these signals to 48 kilohertz by estimating signal values between adjacent samples. The resulting voice segments 105A, 105B serve as inputs to the source location estimation module 106. The detector modules 104A and 104B may perform the up-sampling slightly different up-sampling rates so as to balance a sample rate difference in two input signals.

The source location estimation module 106 may compare two signals to extract a voice segment that is "common" to signals from both microphone 101A, 101B. By way of example, the source location estimation module 106 may perform signal analysis to compare one microphone signal to another by a) identifying speech segments in each signal and b) correlating the speech segments with each other to identify speech segments that are common to both signals.

The source location estimation module 106 may be configured to produce an estimated source location based on a relative energy of the common voice segment from the first and second microphone signals and/or a correlation of the common voice segment from the first and second microphone signals. By way of example, and not by way of limitation, the source location estimation module 106 may track both the energy and correlation of the common voice segment from the two microphone signals until the voice segment ends.

By way of example, and not by way of limitation, the source location estimation module 106 may be configured to estimate a distance to the source from a relative energy c1*c*2 and relative amplitude a1*a*2 of the voice segments 105A, 105B from the two microphones. As used herein the term relative energy (c1*c*2) refers to a value determined using the sum of the squares of the amplitudes of signal samples from both microphones. As used herein the term relative amplitude (a1*a*2) refers to a value determined using a mean of the absolute values of the amplitudes of signal samples from both microphones. Since the signal energy from each microphone depends on the distance from the source to the microphone, it can reasonably be expected that the larger energy signal comes from the microphone closest to the source. By way of example, and not by way of limitation, the relative energy c1*c*2 may be calculated according to Equation 1.1 below.

$$c1c2 = \frac{\sum x_1^2(t)}{\sum x_2^2(t)} \qquad \text{Equation 1.1}$$

By way of example, and not by way of limitation, the relative amplitude a1*a*2 may be calculated according to Equation 1.2 below. The mean amplitude for $x_1(t)$ is calculated on the major voice portion of the signal from the first microphone 101A. The mean amplitude for $x_2(t)$ is calculated on the major voice portion of the signal from the second microphone 101B.

$$a1a2 = \frac{\text{MEAN}|x_1(t)|}{\text{MEAN}|x_2(t)|} \qquad \text{Equation 1.2}$$

In Equations 1.1 and 1.2, the $x_1(t)$ are signal sample amplitudes for the voice segment from the first microphone and the $x_2(t)$ are signal sample amplitudes for the voice segment from the second microphone. In the SingStar example, it may be assumed that desired speech is to come from the first microphone. The location estimation module 106 may compare the relative energy c1*c*2 to a predetermined threshold cc1. If c1*c*2 is at or above the threshold the source may be regarded as "close enough", otherwise the source may be regarded as "not close enough". Similarly the location estimation module 106 may compare the relative amplitude a1*a*2 to a predetermined threshold aa1 to decide the source is either "close enough" in the same manner as c1*c*2 is used.

The decision module 108 may be configured to determine whether the common voice segment is desired or undesired based on the estimated source location. The determination as to whether a voice segment is desired may be based on either consideration of c1*c*2 or of a1*a*2, as the common voice segment is presumed to be desired. By way of example, the decision module 108 may trigger further processing of the voice segment if the estimated source location is "close enough" and disable further processing if the estimated source location is "not close enough".

Until a desired voice segment is found, decision module 108 may go back to input module 104 as indicated at 121 to re-adjust the up-sampling rate, the voice segment alignment between 104A and 104B for a few iteration rounds.

By way of example, if the source of sound for the blue microphone 101A is within a threshold distance, e.g., 1-10 cm, 5 cm in some embodiments, the source can be assumed be the "right" user and the sounds may be analyzed to determine whether they correspond to a command. If not, the sounds may be ignored as noise. The method 200 may include an optional training phase to make the estimate from the source location estimation module 106 and the decision from the decision module 108 more robust.

Further processing of the voice segment may be implemented in any suitable form depending on the result of the decision module 108. By way of example, the decision module 108 may trigger or disable voice recognizer 110 to perform voice recognition processing on the voice segment as a result of the location estimate from the source location estimation module 106.

By way of example, and not by way of limitation, the voice recognition module 110 may receive a voice data 109 corresponding to the first or second voice segment 105A, 105B or some combination of the two voice segments. Each frame of the voice data 109 may be analyzed, e.g., using a Hidden Markov Model (HMM) to determine if the frame contains a known phoneme. The application of Hidden Markov Models to speech recognition is described in detail, e.g., by Lawrence Rabiner in "A Tutorial on Hidden Markov Models and Selected Applications in Speech Recognition" in Proceedings of the IEEE, Vol. 77, No. 2, February 1989, which is incorporated herein by reference in its entirety for all purposes.

Sets of input phonemes determined from the voice data 109 may be compared against phonemes that make up pronunciations in the database 112. If a match is found between the phonemes from the voice data 109 and a pronunciation in an entry in the database (referred to herein as a matching entry), the matching entry word 113 may correspond to a particular change of state of a computer apparatus that is triggered when the entry matched the phonemes determined from the voice signal. As used herein, a "change of state" refers to a change in the operation of the apparatus. By way of example, a change of state may include execution of a command or selection of particular data for use by another process handled by the application 103. A non-limiting example of execution of a command would be for the apparatus to begin the process of selecting a song upon recognition of the word "select". A non-limiting example of selection of data for use by another process would be for the process to select a particular song for play when the input phoneme set 111 matches the title of the song.

A confidence 120 of the recognized word and word boundary information obtained at 113 could be used to refine the operation of the input module 104 to generate a better decision on the voice segment and the recognition output.

It is noted that in some embodiments, the source location estimation module 106 may alternatively be configured to generate an estimated source location in terms of a direction to the source of the speech segment. The source location estimation module 106 may optionally combine the direction estimate with a distance estimate, e.g., as described above to produce an estimated location. There are a number of situations in which a direction estimate may be useful with the context of embodiments of the present invention.

Figure 1B:
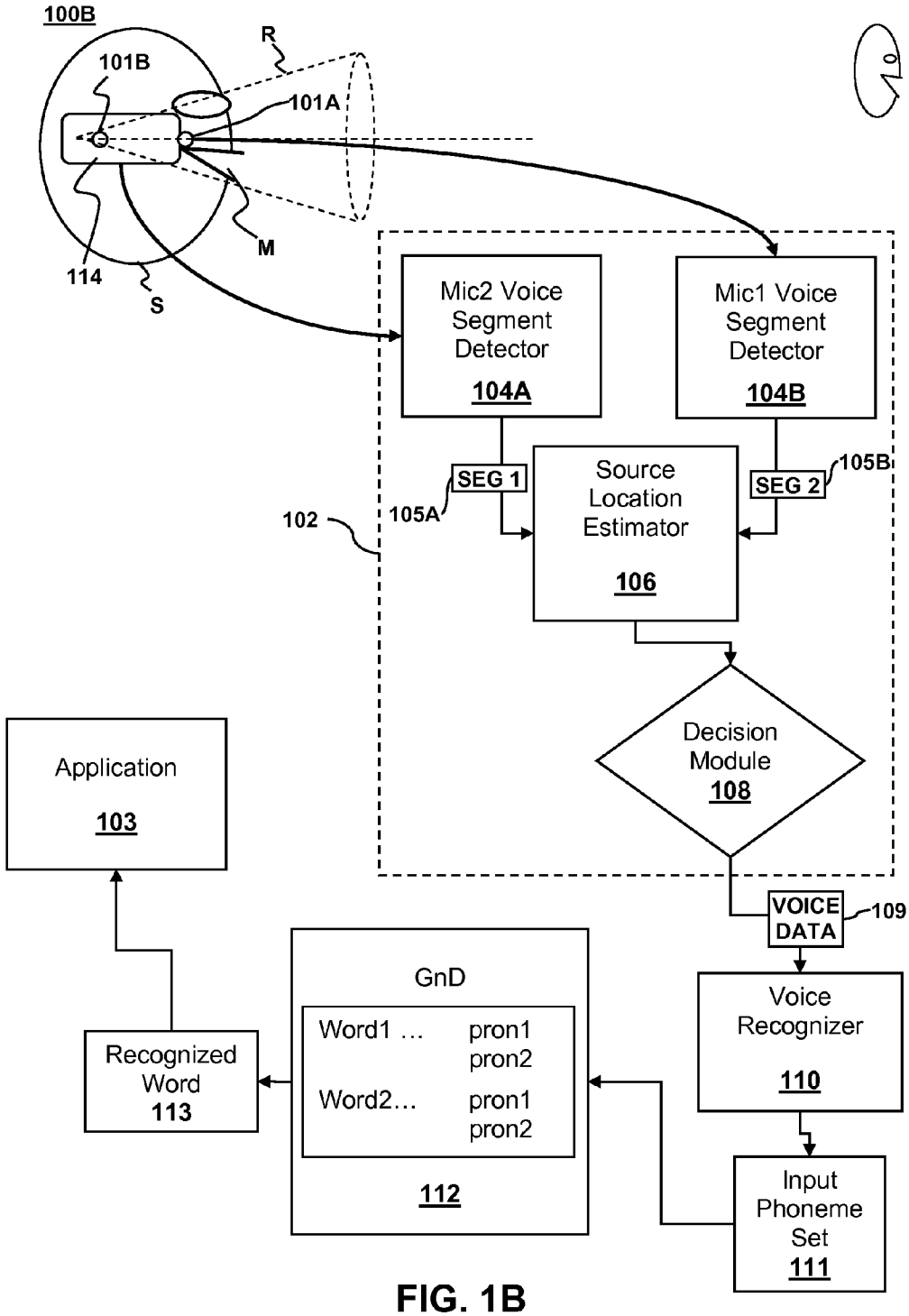

For example, as shown in FIG. 1B, a system 100B utilizes a headset 114 having a near-field microphone 101A and a far-field microphone 101B. Both microphones 101A, 101B may be synchronized to the same clock. The headset 114 and microphones 101A, 101B may be coupled to the rest of the system 100B through a wired or wireless connection. By way of example, the headset may be connected to the rest of the system 100B via a personal area network (PAN) interface, such as a Bluetooth interface. An example of such a headset is described, e.g., in commonly assigned U.S. patent application Ser. No. 12/099,046 entitled "GAMING HEADSET AND CHARGING METHOD" to Xiadong Mao et al. filed Apr. 7, 2008, the entire disclosures of which are incorporated herein by reference. To discriminate between desired and undesired speech in such a headset it is desirable to determine both a distance and a direction to the sound source. For example, in the case depicted in FIG. 1B, a speaker S wearing the headset 114 may issue voice commands that can be recognized by the voice recognizer 110 to trigger changes of state by the application 103. The speaker's mouth M may reasonably be expected to lie within a cone-shaped region R. Any sounds originating outside this region may be ignored. Those originating within this region may be analyzed by the voice recognizer 110. To estimate whether a voice segment originates from a source inside or outside the cone-shaped region R, the source location estimation module 106 may estimate both a direction and a distance to the source of sound.

By way of example, and not by way of limitation, the direction estimate may be obtained from a correlation between the voice segment from the near field microphone and a voice segment from the far-field microphone. The correlation may be calculated from sample values of the two voice segments according to Equation 2.

$$R(c) = \frac{\sum_t x_1(t+c)\cdot x_2(t)}{\sum_t x_1^2(t+c) + x_2^2(t)} \qquad \text{Equation 2}$$

In Equation 1, $x_1(t+c)$ is a signal sample amplitude for the voice segment from the near-field microphone at time t+c, $x_2(t)$ is a signal sample amplitude for the voice segment from the far-field microphone at time t, and c is a time difference between the two samples. The value of the correlation R may be calculated over a whole frame for different possible values of c. From the set of values of R a maximum correlation max_cor may be determined as max_cor=$R_{max}$(c) and the value of c that produces the maximum value of R may be determined as max_c=argmax[R(c)].

The source location estimator 106 may compare the computed value of max_cor to a lower threshold r1, r2, or rr3.

The value of max_c is related to the direction to the speaker's mouth M. In this example, it is expected that the speaker's mouth will be in front of both microphones and closer to the near-field microphone 101A. In such a case, one would expect max_c to lie within some range that is greater than zero since the sound from the speaker's mouth M would be expected to reach the near-field microphone first. The apex angle of the cone-shaped region may by adjusting a value c1 corresponding to an upper end of the range. The source location estimator 106 may compute a value of max_c that is zero if the source is either too far away or located to the side. Such cases may be distinguished by adjusting the upper end of the range.

Since it is also expected that the speaker's mouth is within a certain distance from the near-field microphone, the source location estimator may also generate an estimated distance using a relative energy of the two voice segments as described above.

By way of example, and not by way of limitation, the source location estimation module 106 may implement programmed instructions of the type shown in FIG. 2B. In the example depicted in FIG. 2B, the instructions are written in the C++ programming language. Location determination in accordance with the instructions depicted in FIG. 2B may be summarized as follows. The source of the voice segment may be located within the desired region R if either A) or B) is true:

A) max_c is greater than a minimum threshold c1 and any of the following is true:
   a. max_cor is greater than a first correlation threshold r1; or
   b. the relative energy c1*c*2 is greater than a quantity cc0 and max_cor is greater than a second correlation threshold r2.

B) max_c is greater than or equal to zero and less than c1 and the quantity (1.0f*max_c−max_cor) is less than a third threshold r3 and any of the following is true:
   a. max_cor is greater than a third correlation threshold rr3; or
   b. max_c is greater than or equal to 1 and the relative energy c1*c*2 is greater than an energy threshold cc1; or
   c. max_c is equal to zero and the relative energy c1*c*2 is greater than a second relative energy threshold cc2.

The thresholds c1, r1, r2, r3, rr3, cc0, cc1, cc2 and the parameter f may be adjusted to optimize the performance and robustness of the source location estimation module 106.

Figure 1C:
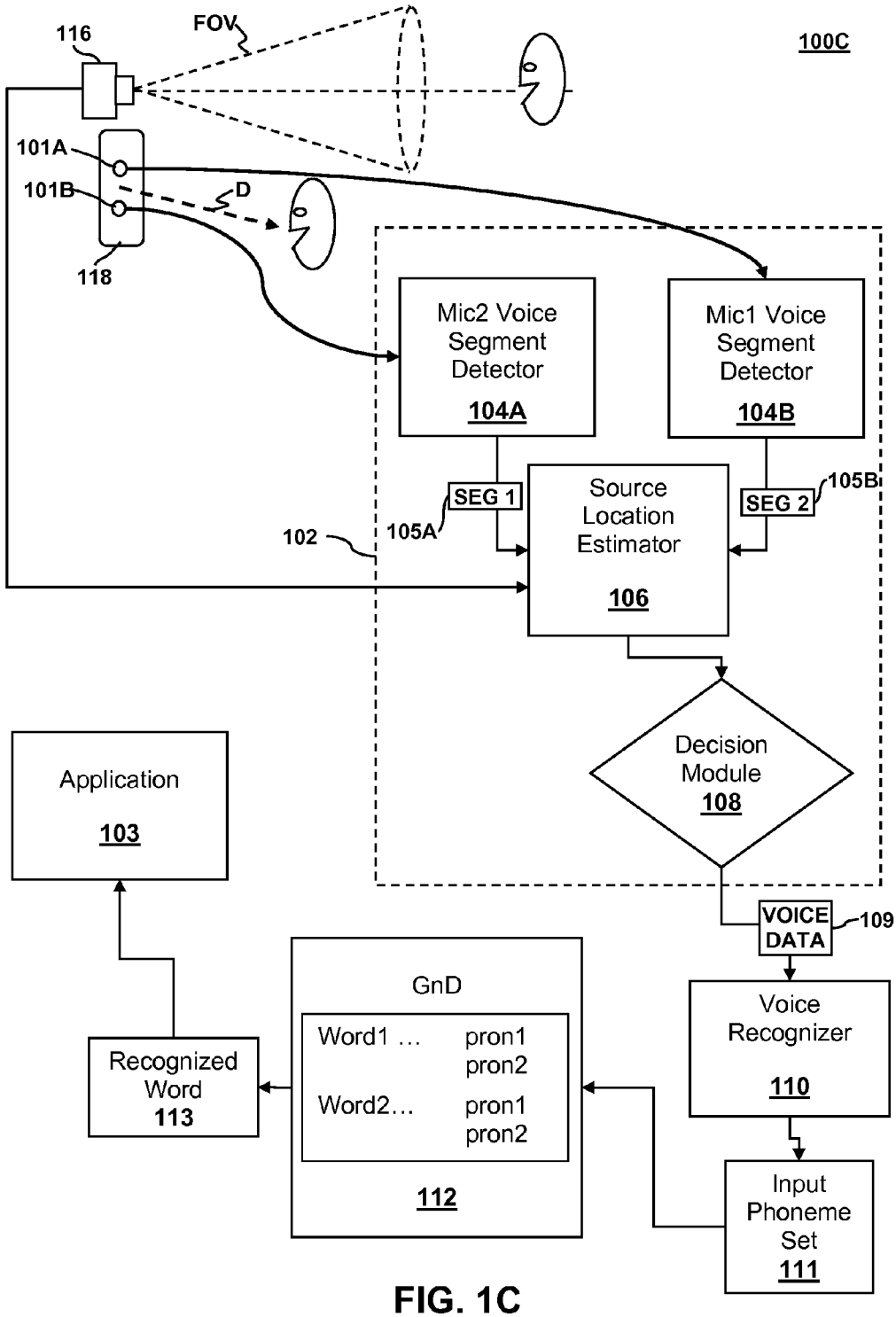

In other embodiments of the invention, the source location estimation module 106 may determine a direction to the source but not necessarily a distance to the source. For example, FIG. 1C illustrates a voice recognition system 100C according to another embodiment of the present invention. The system 100C may be implemented in conjunction with a video camera 116 that tracks a user of the system and a microphone array 118 having two or more microphones 101A, 101B. The microphones 101A, 101B in the array may be synchronized to the same clock. The source location estimation module 106 may be configured to analyze images obtained with the camera 116 (e.g., in electronic form) to track a user's face and mouth and determine whether the user is speaking. Sound signals from two or more microphones 101A, 101B in the array may be analyzed to determine an estimated direction D to a source of sound. The estimated direction D may be determined based on a maximum correlation between voice segments 105A, 105B obtained from the microphones 101A, 101B, and a sample difference value c for which the maximum correlation occurs.

As a simple example, direction estimation may be obtained using program code instructions of the type shown FIG. 2C. In the example depicted in FIG. 2B, the instructions are written in the C++ programming language. In this example, the value of max_c may be determined as described above with respect to FIG. 2B. The value of max_c is compared to a coefficient mic_c that is related to the specific microphones used, e.g., in the headset 114 or in the array 118. An example of a value of mic_c is 8. Generally, value of mic_c may be adjusted, either at the factory or by a user, during a training phase, to optimize operation.

A direction angle may be determined from the inverse cosine of the quantity (max_c/mic_c). The value of max_c may be compared to mic_c and −mic_c. If max_c is less than −mic_c, the value of max_c may be set equal to −mic_c for the purpose of determining arcos(max_c/mic_c). If max_c is greater than mic_c, the value of max_c may be taken as being equal to mic_c for the purpose of determining arcos(max_c/mic_c).

The source location estimation module 106 may combine image analysis with a direction estimate to determine if the source of sound lies within a field of view FOV of the camera.

In some embodiments, a distance estimate may also be generated if the speaker is close enough. Alternatively, in some embodiments, the camera 116 may be a depth camera, sometimes also known as a 3D camera or zed camera. In such a case, the estimation module 106 may be configured (e.g., by suitable programming) to analyze one or more images from the camera 116 to determine a distance to the speaker if the speaker lies within the field of view FOV.

The estimated direction D may be expressed as a vector, which may be projected forward from the microphone array to determine if it intersects the field of view FOV. If the projection of the estimated direction D intersects the field of view, the location source of sounds may be estimated as within the field of view FOV, otherwise, the estimated source location lies outside the field of view FOV. If the source of the sounds corresponding to the voice segments 105A, 105B lies within the field of view FOV, the decision module 108 may trigger the voice recognizer 110 to analyze one voice segment or the other or some combination of both. If the source of sounds corresponding to the voice segments 105A, 105B lies outside the field of view FOV, the decision module may trigger the voice recognizer to ignore the voice segments.

FIGS. 1A-1C and FIGS. 2A-2C depict only a few examples among a number of potential embodiments of the present invention. Other embodiments within the scope of these teachings may combine the features of the foregoing examples.

Figure 3:
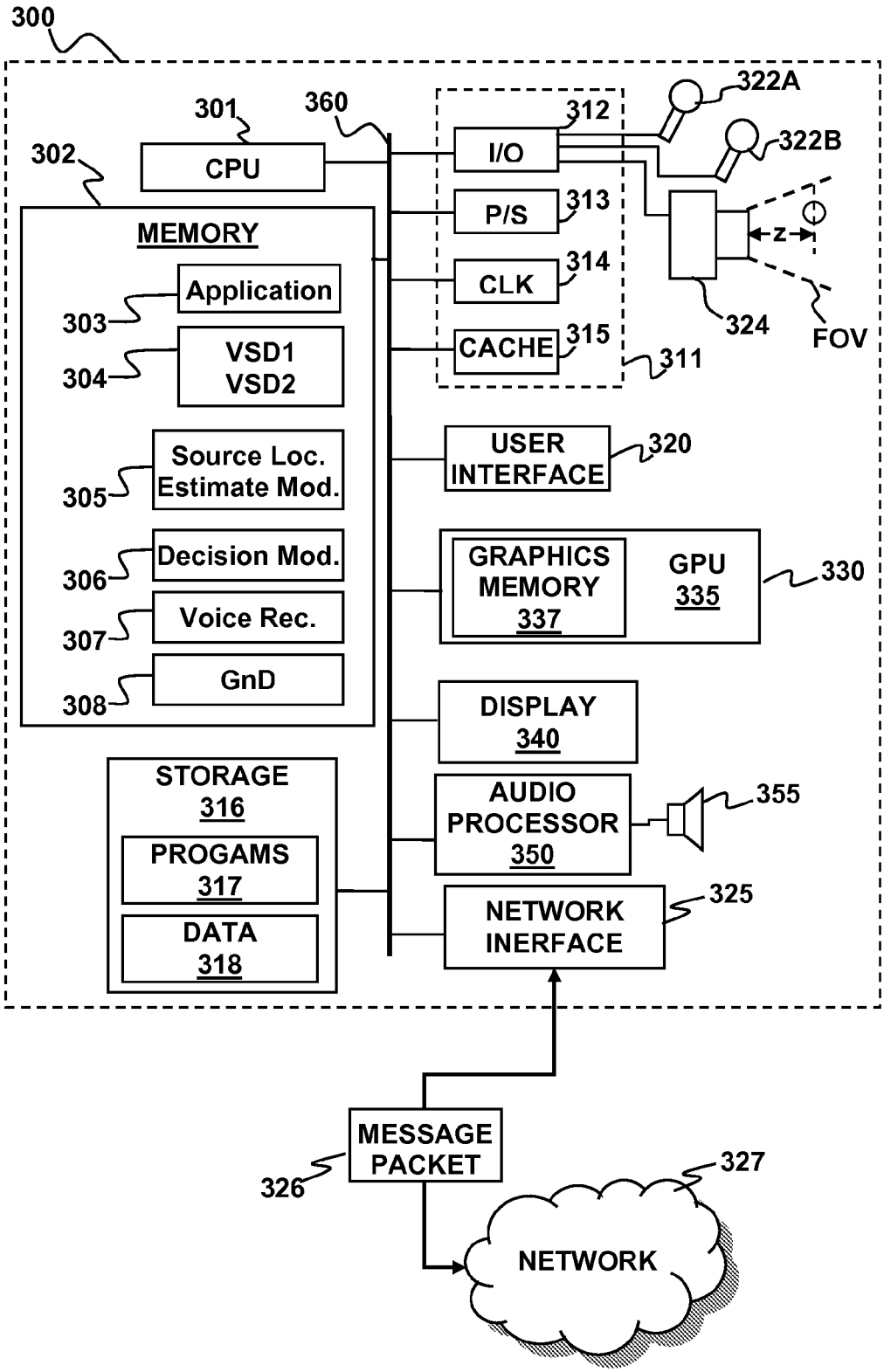
FIG. 3 is a block diagram of a speech processing apparatus according to an embodiment of the present invention.

According to another embodiment, a voice recognition apparatus may be configured in accordance with embodiments of the present invention in any of a number of ways. By way of example, FIG. 3 is a more detailed block diagram illustrating a voice processing apparatus 300 according to an embodiment of the present invention. By way of example, and without loss of generality, the apparatus 300 may be implemented as part of a computer system, such as a personal computer, video game console, personal digital assistant, cellular telephone, hand-held gaming device, portable internet device or other digital device. In a preferred embodiment, the apparatus is implemented as part of a video game console.

The apparatus 300 generally includes a processing unit (CPU) 301 and a memory unit 302. The apparatus 300 may also include well-known support functions 311, such as input/output (I/O) elements 312, power supplies (P/S) 313, a clock (CLK) 314 and cache 315. The apparatus 300 may further include a storage device 316 that provides non-volatile storage for software instructions 317 and data 318. By way of example, the storage device 316 may be a fixed disk drive, removable disk drive, flash memory device, tape drive, CD-ROM, DVD-ROM, Blu-ray, HD-DVD, UMD, or other optical storage devices.

The apparatus may operate in conjunction with first and second microphones 322A, 322B. The microphones may be an integral part of the apparatus 300 or a peripheral component that is separate from the apparatus 300. Each microphone may include an acoustic transducer configured to convert sound waves originating from a common source of sound into electrical signals. By way of example, and not by way of limitation, electrical signals from the microphones 322A, 322B may be converted into digital signals via one or more A/D converters, which may be implemented, e.g., as part of the I/O function 312 or as part of the microphones. The voice digital signals may be stored in the memory 302.

The processing unit 301 may include one or more processing cores. By way of example and without limitation, the CPU 302 may be a parallel processor module, such as a Cell Processor. An example of a Cell Processor architecture is described in detail, e.g., in *Cell Broadband Engine Architecture*, copyright International Business Machines Corporation, Sony Computer Entertainment Incorporated, Toshiba Corporation Aug. 8, 2005 a copy of which may be downloaded at http://cell.scei.co.jp/, the entire contents of which are incorporated herein by reference.

The memory unit 302 may be any suitable medium for storing information in computer readable form. By way of example, and not by way of limitation, the memory unit 302 may include random access memory (RAM) or read only memory (ROM), a computer readable storage disk for a fixed disk drive (e.g., a hard disk drive), or a removable disk drive.

The processing unit 301 may be configured to run software applications and optionally an operating system. Portions of such software applications may be stored in the memory unit 302. Instructions and data may be loaded into registers of the processing unit 302 for execution. The software applications may include a main application 303, such as a video game application. The main application 303 may operate in conjunction with speech processing software, which may include a voice segment detection module 304, a distance and direction estimation module 305, and a decision module 306. The speech processing software may optionally include a voice recognizer 307, and a GnD 308, portions of all of these software components may be stored in the memory 302 and loaded into registers of the processing unit 301 as necessary.

Through appropriate configuration of the foregoing components, the CPU 301 may be configured to implement the speech processing operations described above with respect to FIG. 1, FIG. 2A and FIG. 2B. Specifically, the voice segment detection module 304 may include instructions that, upon execution, cause the processing unit 301 to extract first and second voice segments from digital signals derived from the microphones 322A, 322B and corresponding to a voice sound originating from a common source. The source location estimation module 305 may include instructions that, upon execution, cause the processing unit 301 produce an estimated source location based on a relative energy of the first and second voice segments and/or a correlation of the first and second voice segments. The decision module 306 may include instructions that, upon execution, cause the processing unit 301 to determine whether the first voice segment is desired or undesired based on the estimated source location.

The voice recognizer 307 module may include a speech conversion unit configured to cause the processing unit 301 to convert a voice segment into a set of input phonemes. The voice recognizer 307 may be further configured to compare the set of input phonemes to one or more entries in the GnD 308 and trigger the application 303 to execute a change of state corresponding to an entry in the GnD that matches the set of input phonemes.

The apparatus 300 may include a network interface 325 to facilitate communication via an electronic communications network 327. The network interface 325 may be configured to implement wired or wireless communication over local area networks and wide area networks such as the Internet. The system 300 may send and receive data and/or requests for files via one or more message packets 326 over the network 327.

The apparatus 300 may further comprise a graphics subsystem 330, which may include a graphics processing unit (GPU) 335 and graphics memory 337. The graphics memory 337 may include a display memory (e.g., a frame buffer) used for storing pixel data for each pixel of an output image. The graphics memory 337 may be integrated in the same device as the GPU 335, connected as a separate device with GPU 335, and/or implemented within the memory unit 302. Pixel data may be provided to the graphics memory 337 directly from the processing unit 301. In some embodiments, the graphics unit may receive a video signal data extracted from a digital broadcast signal decoded by a decoder (not shown). Alternatively, the processing unit 301 may provide the GPU 335 with data and/or instructions defining the desired output images, from which the GPU 335 may generate the pixel data of one or more output images. The data and/or instructions defining the desired output images may be stored in memory 302 and/or graphics memory 337. In an embodiment, the GPU 335 may be configured (e.g., by suitable programming or hardware configuration) with 3D rendering capabilities for generating pixel data for output images from instructions and data defining the geometry, lighting, shading, texturing, motion, and/or camera parameters for a scene. The GPU 335 may further include one or more programmable execution units capable of executing shader programs.

The graphics subsystem 330 may periodically output pixel data for an image from the graphics memory 337 to be displayed on a video display device 340. The video display device 350 may be any device capable of displaying visual information in response to a signal from the apparatus 300, including CRT, LCD, plasma, and OLED displays that can display text, numerals, graphical symbols or images. The digital broadcast receiving device 300 may provide the display device 340 with a display driving signal in analog or digital form, depending on the type of display device. In addition, the display 340 may be complemented by one or more audio speakers that produce audible or otherwise detectable sounds. To facilitate generation of such sounds, the apparatus 300 may further include an audio processor 350 adapted to generate analog or digital audio output from instructions and/or data provided by the processing unit 301, memory unit 302, and/or storage 316. The audio output may be converted to audible sounds, e.g., by a speaker 355.

The components of the apparatus 300, including the processing unit 301, memory 302, support functions 311, data storage 316, user input devices 320, network interface 325, graphics subsystem 330 and audio processor 350 may be operably connected to each other via one or more data buses 360. These components may be implemented in hardware, software or firmware or some combination of two or more of these.

Embodiments of the present invention are usable with applications or systems that utilize a camera, which may be a depth camera, sometimes also known as a 3D camera or zed camera. By way of example, and not by way of limitation, the apparatus 300 may optionally include a camera 324, which may be a depth camera, which, like the microphones 322A, 322B, may be coupled to the data bus via the I/O functions. The main application 303 may analyze images obtained with the camera to determine information relating to the location of persons or objects within a field of view FOV of the camera 324. The location information can include a depth z of such persons or objects. The main application 304 may use the location information in conjunction with speech processing as described above to obtain inputs.

Figure 4:
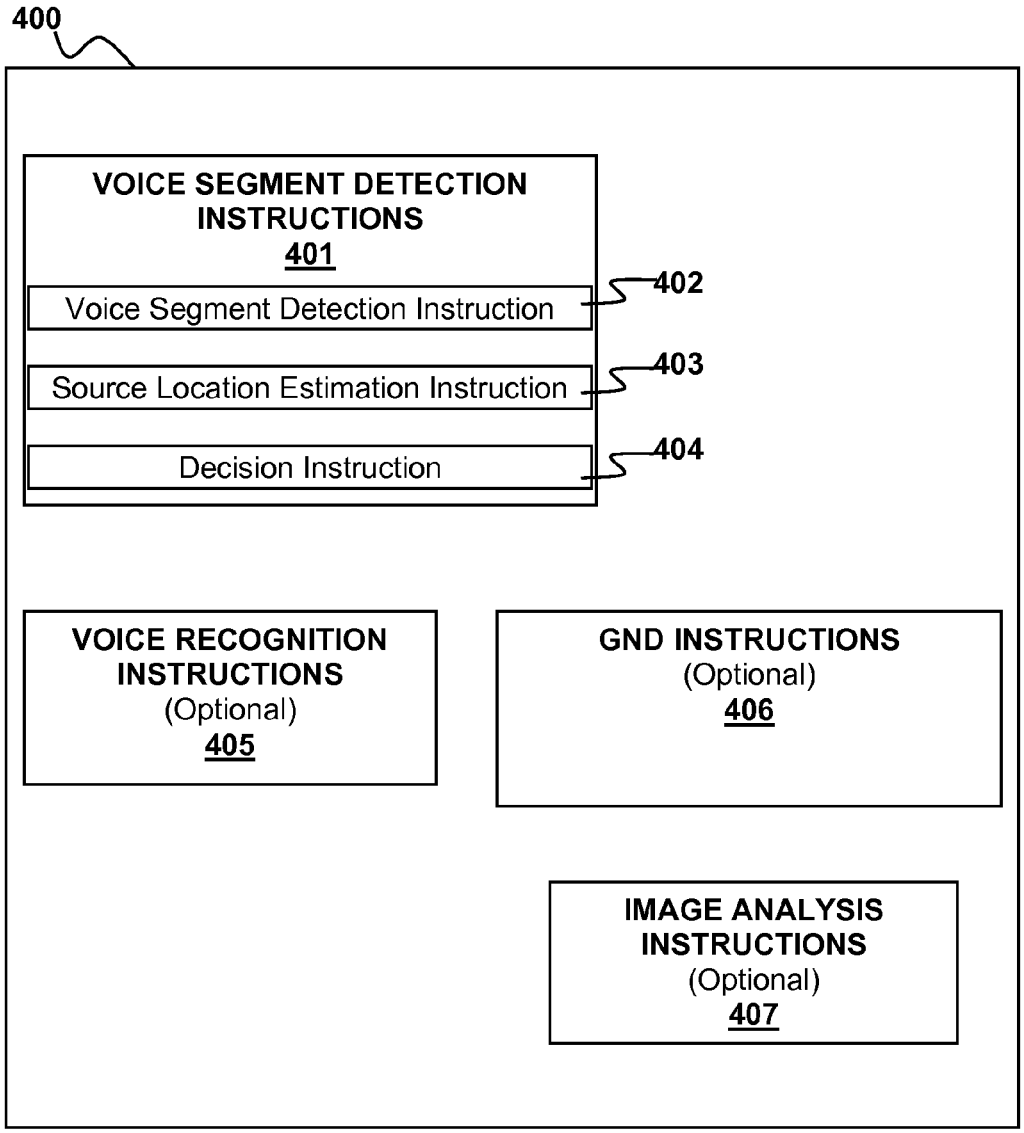
FIG. 4 is a block diagram of a computer readable medium containing computer readable instructions for implementing speech processing in accordance with an embodiment of the present invention.

According to another embodiment, instructions for carrying out speech recognition processing as described above may be stored in a computer readable storage medium. By way of example, and not by way of limitation, FIG. 4 illustrates an example of a computer-readable storage medium 400. The storage medium contains computer-readable instructions stored in a format that can be retrieved interpreted by a computer processing device. By way of example, and not by way of limitation, the computer-readable storage medium 400 may be a computer-readable memory, such as random access memory (RAM) or read only memory (ROM), a computer readable storage disk for a fixed disk drive (e.g., a hard disk drive), or a removable disk drive. In addition, the computer-readable storage medium 400 may be a flash memory device, a computer-readable tape, a CD-ROM, a DVD-ROM, a Blu-ray, HD-DVD, UMD, or other optical storage medium.

The storage medium 400 contains voice discrimination instructions 401 including one or more voice segment instructions 402, one or more source location estimation instructions 403 and one or more decision instructions 404. The voice segment instructions 402 may be configured such that, when executed by a computer processing device, they cause the device to extract first and second voice segments from digital signals derived from first and second microphone signals and corresponding to a voice sound originating from a common source. The instructions 403 may be configured such that, when executed, they cause the device to produce an estimated source location based on a relative energy of the first and second voice segments and/or a correlation of the first and second voice segments. The decision instructions 404 may include instructions that, upon execution, cause the processing device to determine whether the first voice segment is desired or undesired based on the estimated source location. The decision instructions may trigger a change of state of the processing device based on whether the first voice segment is desired or undesired.

The storage medium may optionally include voice recognition instructions 405 and a GnD 406 configured such that, when executed, the voice recognition instructions 405 cause the device to convert a voice segment into a set of input phonemes, compare the set of input phonemes to one or more entries in the GnD 406 and trigger the device to execute a change of state corresponding to an entry in the GnD that matches the set of input phonemes.

The storage medium 400 may also optionally include one or more image analysis instructions 407, which may be configured to operate in conjunction with source location estimation instructions 403. By way of example, the image analysis instructions 407 may be configured to cause the device to analyze an image from a video camera and the location estimation instructions 403 may determine from an estimated direction and an analysis of the image whether a source of sound is within a field of view of the video camera.

Embodiments of the present invention provide a complete system and method to automatically determine whether a voice signal is originating from a desired source. Embodiments of the present invention have been used to implement a voice recognition that is memory and computation efficient as well as robust. Implementation has been done for the PS3 Bluetooth headset, the PS3EYE video camera SingStar microphones and SingStar wireless microphones.

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. Any feature described herein, whether preferred or not, may be combined with any other feature described herein, whether preferred or not. In the claims that follow, the indefinite article "A", or "An" refers to a quantity of one or more of the item following the article, except where expressly stated otherwise. The appended claims are not to be interpreted as including means-plus-function limitations, unless such a limitation is explicitly recited in a given claim using the phrase "means for".

What is claimed is:

1. A computer speech processing system, comprising:

one or more voice segment detection modules configured to extract first and second voice segments from first and second microphone signals originating from first and second microphones, wherein the first and second voice segments correspond to a voice sound originating from a common source;

a source location estimation module configured to produce an estimated source location based on a relative energy of the first and second voice segments and/or a correlation of the first and second voice segments;

a decision module configured to determine whether the voice segment is desired or undesired based on the estimated source location;

wherein the decision module is further configured to enable processing of a desired voice segment by a speech recognition module and disable processing of an undesired speech segment by the speech recognition module.

2. The system of claim 1, further comprising:

a speech recognition module coupled to the decision module, wherein the speech recognition module configured to convert the first voice segment into a group of input phonemes, compare the group of phonemes to one or more entries in a database stored in a memory, and trigger a change of state of the system corresponding to a database entry that matches the group of input phonemes.

3. The system of claim 1 wherein the source location estimation module is configured to generate an estimated distance to the source from the relative energy of the first and second voice segments.

4. The system of claim 3, wherein the decision module is configured to determine whether the first voice segment is desired or undesired based on the estimated distance.

5. The system of claim 3, wherein the source location estimation module is further configured to generate an estimated direction to the common source from on a correlation of the first and second voice segments.

6. The system of claim 5, wherein the decision module is configured to determine whether the first voice segment is desired or undesired based on the estimated distance and the estimated direction.

7. The system of claim 5, wherein the first microphone signal is from a near-field microphone and the second signal is from a far-field microphone.

8. The system of claim 5, wherein the decision module is configured to analyze an image from a video camera and determine from the estimated direction and an analysis of the image whether the common source is within a field of view of the video camera.

9. The system of claim 8, wherein the video camera is a depth camera and the estimation module is configured to analyze one or more images from the depth camera to determine the estimated distance.

10. The system of claim 1 wherein the first and second microphones are synchronized to a common clock.

11. In a computer voice processing system having a processing unit and a memory unit, and first and second microphones coupled to the processing unit a computer implemented method for voice recognition, the method comprising:

a) extracting first and second voice segments from first and second microphone signals originating from the first and second microphones, wherein the first and second voice segments correspond to a voice sound originating from a common source;

b) producing an estimated source location based on a relative energy of the first and second voice segments and/or a correlation of the first and second voice segments;

c) determining whether the first voice segment is desired or undesired based on the estimated source location; and d) enabling processing of a desired voice segment by the speech recognition module and disabling processing of an undesired speech segment by the speech recognition module.

12. The method of claim 11, further comprising:

d) changing a state of the system based on whether the first voice segment is desired or undesired.

13. The method of claim 12, wherein d) comprises:

e) converting the first voice segment into a group of input phonemes;

f) comparing the group of phonemes to one or more entries in the database; and g) executing a command corresponding to an entry that matches the group of input phonemes.

14. The method of claim 11, wherein b) includes generating an estimated distance to the common source from the relative energy of the common voice segment from the first and second microphone signals.

15. The method of claim 14, wherein c) includes determining whether the voice segment is desired or undesired based on the estimated distance.

16. The method of claim 15, wherein b) includes generating an estimated direction to the source from on a correlation of the common voice segment from the first and second microphone signals.

17. The method of claim 16, wherein c) includes determining whether the voice segment is desired or undesired based on the estimated distance and the estimated direction.

18. The method of claim 16, wherein the first microphone signal is from a near-field microphone and the second signal is from a far-field microphone.

19. The method of claim 16, wherein c) includes analyzing an image from a video camera and determining from the estimated direction and an analysis of the image whether the source of sound is within a field of view of the video camera.

20. The method of claim 19, wherein the video camera is a depth camera and the estimated distance is determined by analyzing one or more images from the depth camera.

21. The method of claim 11 wherein the first and second microphones are synchronized to a common clock.

22. A non-transitory computer readable storage medium, having embodied therein computer readable instructions executable by a computer speech processing apparatus having a processing unit and a memory unit, the computer readable instructions being configured to implement a speech processing method upon execution by the processor, the method comprising:

a) extracting first and second voice segments from first and second microphone signals originating from the first and second microphones, wherein the first and second voice segments correspond to a voice sound originating from a common source;

b) producing an estimated source location based on a relative energy of the first and second voice segments and/or a correlation of the first and second voice segments;

c) determining whether the first voice segment is desired or undesired based on the estimated source location; and d) enabling processing of a desired voice segment by the speech recognition module and disabling processing of an undesired speech segment by the speech recognition module.

* * * * *